US006604739B2

(12) United States Patent
Förch et al.

(10) Patent No.: US 6,604,739 B2
(45) Date of Patent: Aug. 12, 2003

(54) METHOD AND DEVICE FOR ALIGNING FLAT COPIES IN SHEET-PROCESSING MACHINES

(75) Inventors: Peter Förch, Neustadt (DE); Andreas Henn, Neckargemünd (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 61 days.

(21) Appl. No.: 10/036,166

(22) Filed: Nov. 9, 2001

(65) Prior Publication Data

US 2002/0096824 A1 Jul. 25, 2002

(30) Foreign Application Priority Data

Nov. 9, 2000 (DE) ..... 100 55 580

(51) Int. Cl.[7] ..... B65H 7/02
(52) U.S. Cl. ..... 271/228; 271/268; 271/277
(58) Field of Search ..... 271/226, 227, 271/228, 268, 277; 400/579; B65H 7/02, 9/00, 5/12, 5/02

(56) References Cited

U.S. PATENT DOCUMENTS 4,860,651 A 8/1989 Ishii et al.
5,527,027 A 6/1996 Flade et al.
6,145,211 A * 11/2000 Typpo et al. ..... 33/501.02
2001/0040331 A1 * 11/2001 Forch et al. ..... 270/58.01
2002/0063381 A1 * 5/2002 Henn ..... 271/226

FOREIGN PATENT DOCUMENTS

DE 29 24 636 A1 1/1981
DE 36 44 431 A1 9/1988
DE 42 39 732 A1 6/1994
DE 43 23 091 A1 * 1/1995 ..... B41F/33/06
DE 198 52 361 A1 5/2000
EP 0 453 789 A1 10/1991

* cited by examiner

*Primary Examiner*—Donald P. Walsh
*Assistant Examiner*—Kenneth W Bower
(74) *Attorney, Agent, or Firm*—Laurence A. Greenberg; Werner H. Stemer; Ralph E. Locher

(57) ABSTRACT

A method of aligning flat copies in a sheet-processing machine includes the steps of determining the actual position of a sheetlike material in relation to a coordinate system; implementing a nominal position of a cylinder that accommodates the sheetlike material to be aligned on the jacket surface of the cylinder by correctively controlling non-contacting radial/axial magnetic bearings so as to compensate for position changes of the cylinder or components thereof from the nominal position; and maintaining the cylinder in the nominal position thereof until the aligned sheet material is transferred to transport units arranged farther downline; a device for performing the method; a printing unit having the device; and a multicolor rotary printing machine having the device.

20 Claims, 6 Drawing Sheets

1
2
3
X
Y
Z 15
17
8
13
9
7
12
16
5
14
11
6
10

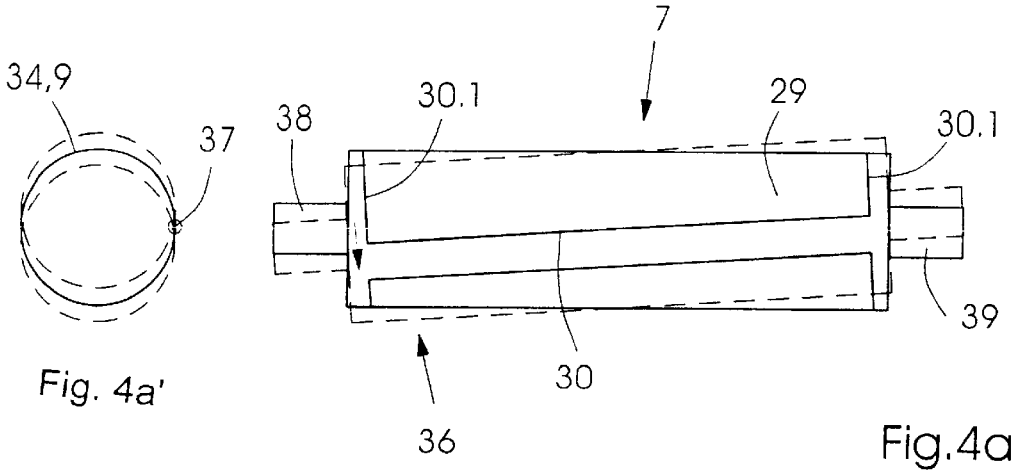
Fig. 4a'
Fig.4a
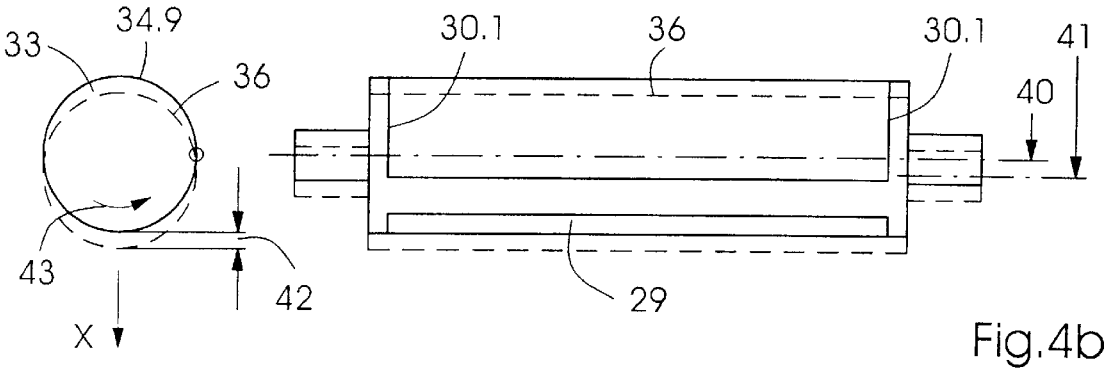
Fig. 4b'
Fig.4b
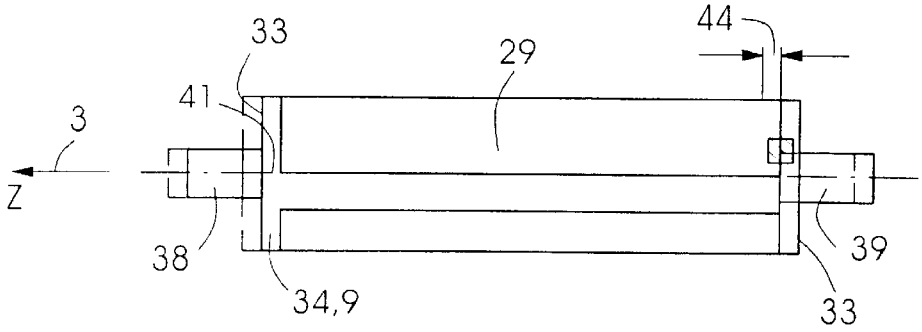
Fig.4c

METHOD AND DEVICE FOR ALIGNING FLAT COPIES IN SHEET-PROCESSING MACHINES

BACKGROUND OF THE INVENTION

Field of the Invention

The invention relates to a method and a device for aligning flat copies in sheet-processing machines, such as multicolor rotary printing machines having a plurality of printing units arranged behind one another or in tandem.

The published German Patent Document DE 29 24 636 A1 is concerned with a control device for a sheet gripper device, wherein the sheet grippers are movable in axial direction. A number of sheet grippers for gripping the leading edge of a printed sheet between gripper fingers and gripper pads is provided, the gripper pads being fixed onto a gripper pad rail supporting the gripper spindle in bearings. The sheet grippers are arranged so as to be displaceable in the axial direction of the gripper spindle and of the gripper pad rail, for the purpose of aligning a printed sheet laterally, the gripper pad rail being fixed to the body of an impression cylinder and a transfer drum, respectively, or to the body of a pregripper by leaf-type spring supports which are deflectable in the axial direction of the gripper spindle and the gripper pad rail. The axial displacement of the gripper pad rail is performed by an actuating motor, which can be driven via a servo-controller circuit by light-sensitive elements which sense at least one edge of a printed sheet in relation to a locally fixed reference line.

With such a construction, lateral displacement of a sheet material in relation to the conveying direction thereof is possible, but the lateral alignment according to this construction must necessarily be subject to inaccuracies as a result of the play which is necessarily inherent therein due to the mechanical components.

Published German Patent Document DE 36 44 431 A1 discloses a sheet gripper device in a rotary printing machine having sheet grippers which are likewise movable in the axial direction. The sheet gripper device is suitable for cylinders and drums of sheet-fed rotary printing machines, sheet grippers being accommodated on an axially displaceable carriage for the purpose of lateral alignment of the sheets to be printed. The axial movement of the axially displaceable carriage that accommodates the sheet grippers is produced by a control cam, which is arranged so that it is pivotable in the direction of a side surface of the drum and away therefrom.

For register accuracy and for freedom from ghosting, which is to be preserved, a reproducible position of the sheet material conveyed through a printing machine is imperative. In the case of a sheet-fed rotary printing machine, the sheet material is generally aligned in the feeder and taken over by gripper systems, which can include a pregripper system for accelerating the sheet to machine speed. The gripper systems convey the sheet material, with an interposition of various transfer points, as far as the sheet delivery. The alignment process which takes place in the feeder of the sheet material is relatively complicated, because many mechanical components are involved in the alignment process, and the driveability thereof at high speeds of 13,000 prints per hour or more approaches the limits thereof. Heretofore, printing criteria, such as the maintenance of the circumferential and the lateral register, could be corrected only on average by the register.

SUMMARY OF THE INVENTION

Considering the developments in the prior art and the indicated technical problem, it is an object of the invention of the instant application to provide a method and a device for aligning a cylinder in a sheet-processing machine.

With the foregoing and other objects in view, there is provided, in accordance with one aspect of the invention, a method of aligning flat copies in a sheet-processing machine, which comprises the steps of determining the actual position of a sheetlike material in relation to a coordinate system; implementing a nominal position of a cylinder that accommodates the sheetlike material to be aligned on the jacket surface of the cylinder by correctively controlling non-contacting radial/axial magnetic bearings so as to compensate for position changes of one of the cylinder and components thereof from the nominal position; and maintaining the cylinder in the nominal position thereof until the aligned sheet material is transferred to transport units arranged farther downline.

In accordance with another mode, the method of the invention includes guiding the sheetlike material during the rotation of the cylinder, and detecting the actual position of the leading edge and side edges of the sheetlike material by sensors.

In accordance with a further mode, the method includes independently displacing the cylinder, which guides the sheetlike material, on the drive side and on the operating side of the cylinder, for correcting a skewed position of the sheetlike material.

In accordance with an added mode, the method includes performing a like displacement of the cylinder, which guides the sheetlike material, both on the drive side and on the operating side of the cylinder, for correcting a circumferential position of the sheetlike material.

In accordance with an additional mode, the method includes axially displacing the cylinder, which guides the sheetlike material, for correcting the erroneous position of the sheetlike material.

In accordance with yet another mode, the method includes monitoring the nominal position of the cylinder, which guides the aligned sheetlike material, by axial and radial sensors, respectively, for controlling the radial/axial magnetic bearings.

In accordance with another aspect of the invention, there is provided a method of aligning cylinders carrying a printed image in a printing machine, which comprises the steps of determining the actual position of the printed image in relation to a coordinate system; and implementing a nominal position of a cylinder that accommodates the printed image to be aligned on the jacket surface of the cylinder by correctively controlling radial/axial magnetic bearings so as to compensate for position changes of one of the cylinder and components thereof from the nominal position.

In accordance with a further mode, the method of the invention includes, during the rotation of the cylinder carrying the printed image, detecting by sensors the actual position of the cylinder carrying the printed image.

In accordance with an added mode, the method includes independently displacing the cylinder, which carries the printed image, on the drive side and on the operating side of the cylinder, for correcting a skewed position of the printed image.

In accordance with an additional mode, the method includes axially displacing the cylinder, which carries the printed image, for correcting the erroneous position of the printed image.

In accordance with a further aspect of the invention, there is provided a device for aligning flat copies in sheet-processing machines such as multicolor rotary printing machines or digitally operating printing machines wherein sheetlike material is conveyed by gripping devices on a circumferential surface of a driven cylinder, comprising radial/axial bearings for mounting the driven cylinder without contact therewith, the driven cylinder being accommodated in side walls and serving to carry the sheetlike material, and sensors assigned to the radial/axial bearings for detecting axial and radial position changes, respectively.

In accordance with an added aspect of the invention, there is provided a device for aligning printed images in printing machines, such as multicolor rotary printing machines or digitally operating printing machines wherein a printed image is carried by at least one cylinder selected from the group thereof consisting of printing form cylinders and transfer cylinders, comprising radial/axial bearings for mounting the cylinder without contact therewith, the cylinder being accommodated in side walls, and sensors assigned to the radial/axial bearings for detecting axial and radial position changes, respectively.

In accordance with another feature of the invention, accommodated on the cylinders carrying the printed image, are sensors for detecting the position of a leading edge and a side edge of the printed image.

In accordance with a further feature of the invention, the sensors serve for detecting the position of the sheetlike material on the circumference of the cylinder and are constructed as at least one of CCD arrays and linear CCD sensors.

In accordance with an added feature of the invention, the sensors serve for detecting the position of the sheetlike material on the surface of the cylinder and are constructed as at least one of capacitive and inductive sheet edge detectors.

In accordance with an additional feature of the invention, the device includes a drive to the cylinder carrying the sheetlike material, the drive being provided via a drive element connected via couplings to a drive shaft of the cylinder, the couplings serving for decoupling radial and axial movements of the cylinder.

In accordance with yet another feature of the invention, the drive shaft is constructed as a cardan or universal shaft.

In accordance with an additional aspect of the invention, there is provided a printing unit having a device for aligning flat copies in sheet-processing machines such as multicolor rotary printing machines or digitally operating printing machines wherein sheetlike material is conveyed by gripping devices on a circumferential surface of a driven cylinder, comprising radial/axial bearings for mounting the driven cylinder without contact therewith, the driven cylinder being accommodated in side walls and serving to carry the sheetlike material, and sensors assigned to the radial/axial bearings for detecting axial and radial position changes, respectively.

In accordance with a concomitant aspect of the invention, there is provided a multicolor rotary printing machine having a device for aligning flat copies in sheet-processing machines wherein sheetlike material is conveyed by gripping devices on a circumferential surface of a driven cylinder, comprising radial/axial bearings for mounting the driven cylinder without contact therewith, the driven cylinder being accommodated in side walls and serving to carry the sheetlike material, and sensors assigned to the radial/axial bearings for detecting axial and radial position changes, respectively.

The aforementioned object of the invention is thus achieved by a method of aligning flat copies in sheet-processing machines which includes the following method steps:

the actual position of the sheet material in relation to a coordinate system is determined, then, a nominal or intended position of a cylinder that accommodates the sheet material to be aligned on the outer jacket surface thereof is implemented, by radial/axial magnetic bearings bearing the cylinder without contact, the bearings being controlled for compensating for the position deviations of the cylinder and the components thereof from the nominal position, and the nominal position of the cylinder carrying the sheet material to be aligned is maintained until the aligned sheet material is transferred to further transport sheet conveying units.

The method and device of the invention is advantageous for form or plate cylinders for carrying printing forms or also for transfer cylinders for carrying a printed image, for example, rubber blanket cylinders.

With the method proposed according to the invention, the sheet position may be varied by changing the position of a cylinder for carrying the sheet material or for carrying the printed image. The cylinder accommodating the sheet material on the outer jacket surface thereof can be displaced in the X and Y direction, so that the sheet material held on the outer jacket surface thereof by gripping devices is also displaced. The position of the cylinder carrying the sheet material to be aligned is varied, until the aligned sheet material is transferred to the next cylinder or the next transport unit, so that any faulty positions of the sheet with regard to circumferential position, skewed position and lateral alignment of the sheet are corrected, and the sheet can therefore be transferred in-register. By the proposed method, the complicated alignment process of the as yet unprinted sheet material in the feeder could be dispensed with. In addition, the method proposed by the invention offers the possibility of correcting the sheet position of the sheet material in the printing machine during the sheet run. As a result, the method proposed by the invention provides a considerable improvement in the maintenance of printing quality criteria. In particular, with cylinders carrying the printed image, side register and diagonal register are remotely adjusted.

In one mode of the method proposed by the invention, the actual position of the sheetlike material or of the printed image during the rotation of the cylinder guiding the sheetlike material or the cylinder carrying the printed image is determined to the same extent on the drive side and the operating side during the rotation of the cylinder conveying the sheet material, for which purpose sensors are used.

According to one aspect of the method proposed by the invention, by an independent displacement on the drive side and the operating side of the cylinder carrying the sheet material, a skewed position of the sheetlike material can be corrected during the passage thereof through a printing unit. In addition, by a like displacement both on the drive side and on the operating side of the cylinder carrying the sheet material, correcting the circumferential position of the sheet material in the printing unit is possible.

The method proposed by the invention may further be used to compensate for axial displacement of the cylinder carrying the sheetlike material in order to correct an erroneous position of the sheetlike material in the printing unit of a multicolor rotary printing machine.

The nominal position of the cylinder carrying the sheet material, implemented by driving axially/radially acting magnetic bearings of the cylinder, can be monitored by axial and radial sensors which control radial and axial magnetic bearings.

The object of the invention is also achieved by a device for aligning flat copies in sheet-processing machines, such as multicolor offset rotary machines or digitally operating printing machines, wherein the sheet material is conveyed by gripping devices on the circumferential surface of driven sheet-carrying cylinders, and driven cylinders accommodated in the side walls and carrying the sheet material are accommodated in these non-contacting radial/axial bearings, to which there are assigned detecting sensors for detecting axial and radial position changes.

The use of magnetic bearings as actuators permits the position of a paper-guiding cylinder, whether it is a transfer or a feed cylinder, to be corrected in three spatial directions by the amount of a detected erroneous position. Magnetic bearings have a non-contact operating mode, the magnetic forces being transmitted to the cylinder in the form of a load-bearing force via an air gap. Depending upon the detected positional deviation of the sheetlike material, the position of the cylinder carrying the sheetlike material, and therefore the position of the sheetlike material within the rotational system can be corrected by driving the coils of the magnetic bearings acting in the axial and radial direction. Moreover, the bearings do not need any lubrication and therefore no lubricants are necessary. By using magnetic bearings, cylinder imbalance and radial cam forces can be compensated for. Flexural oscillations of the cylinder do not occur, it being necessary for the forces arising from the weight of the cylinder that accommodates the sheetlike material on the outer jacket surface thereof to be reduced as much as is possible.

In a further refinement of the concept upon which the invention is based, the position of the leading edge and of the side edge of the sheet material is provided with sensors sensing the position thereof on the cylinders carrying the sheetlike material to be aligned. Therefore, at a fixed time shortly after the transfer of the sheetlike material to the outer jacket surface, the sheet position is determined. Because of the actual position of the sheetlike material detected by the sensor system, the displacement of the cylinder carrying the sheetlike material which may be needed in order to correct an erroneous position can be determined. The sensors detecting the position of the sheet-guiding material on the circumference of the cylinder can be constructed as CCD arrays or linear CCD sensors. Furthermore, sheet edge sensors which operate purely capacitively or inductively can be provided in the outer jacket surfaces in the region of the gripping devices on the cylinders carrying the sheetlike material, whether they are transfer drums or feed drums.

The drive to the cylinder carrying the sheetlike material can preferably be implemented via a drive element which, via clutches which decouple or tune out the radial and axial movements of the cylinder, is provided with a take-up shaft of the cylinder. Particularly suitable for this purpose is a drive shaft based upon the cardan or universal principle. With this drive construction, it is possible to prevent the introduction of unnecessary additional forces, which would have to be compensated for by the magnetic bearings. Cardan shafts further have the advantage of a very rigid rotational connection.

The method proposed by the invention for aligning sheetlike materials, and the device proposed in accordance with the invention may be implemented in particular in printing units of rotary printing machines, whether they are conventional multicolor rotary printing machines of in-line construction or rotary printing machines operating on the digital principle.

Other features which are considered as characteristic for the invention are set forth in the appended claims.

Although the invention is illustrated and described herein as embodied in a method and a device for aligning flat copies in sheet-processing machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

BRIEF DESCRIPTION OF THE DRAWINGS

FIG. 1' is a fragmentary end view of FIG. 1 with a coordinate system;

FIG. 3' is an end view of FIG. 3 with the cylinder journal thereof omitted.

FIG. 4*a* is a diagrammatic side elevational view of a cylinder carrying sheetlike material in a skewed position;

FIG. 4*a'* is an end view of FIG. 4*a* with the cylinder journal thereof omitted;

FIG. 4*b* is a diagrammatic side elevational view of a cylinder guiding sheetlike material and a displacement of the cylinder in circumferential direction thereof;

FIG. 4*b'* is an end view of FIG. 4*b* with the cylinder journal thereof omitted;

FIG. 4*c* is a diagrammatic side elevational view of a cylinder guiding sheetlike material and showing a lateral displacement of the sheetlike material in order to compensate for an erroneous lateral position of the sheetlike material;

DESCRIPTION OF THE PREFERRED EMBODIMENTS

Figure 1:
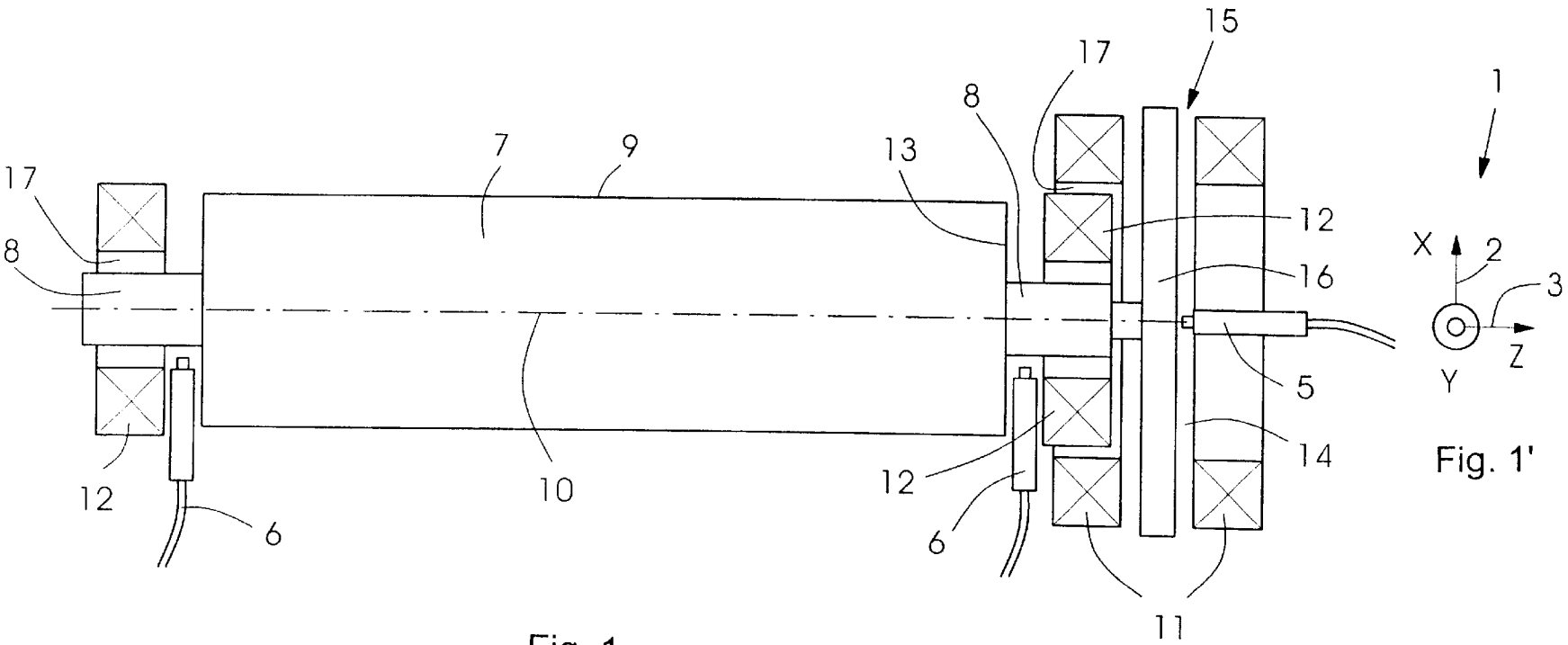
FIG. 1 is a diagrammatic side elevational view shows a basic construction of a non-contact magnetic mounting of a cylinder for guiding sheetlike material.

Referring now to the drawings and, first, particularly to FIG. 1 thereof, there is shown therein in a diagrammatic representation, a non-contact mounting of a cylinder accommodating sheet material on the jacket surface thereof.

FIG. 1' shows a coordinate system 1 having a Y axis 4 running perpendicularly to the plane of the drawing of FIG. 1'. The coordinate system 1 further has an X axis 2, and finally a Z axis 3 extending parallel to the cylinder axis 10.

As shown in FIG. 1, a cylinder 7 conveying sheet material on the jacket surface 9 thereof has an axial directional sensor 5 assigned thereto, which is coaxial with the cylinder axis 10. Attached to the cylinder 7, respectively extending from the end faces 13 thereof, are cylinder journals 8 to which vertically oriented radial directional sensors 6 are fitted. The cylinder 7 guiding sheet material 29 has a closed jacket surface 9 wherein gripping devices, which are otherwise specifically illustrated in FIG. 1, are integrated.

According to the configuration of FIG. 1, the journals 8 of the cylinder 7 are mounted in radial magnetic bearings 12, radial air gaps 17 being established between the surfaces of the radial magnetic bearings 12, which are directed towards the journals 8 and the outer circumferential surfaces of the cylinder journals 8, and permitting the journals 8 to be accommodated without contact in the bores within the radial magnetic bearings 12.

Attached to one of the journals 8 of the cylinder 7 is a disk-like element 16. Opposite the disk-like element 16, arranged on one side coaxially with the cylinder axis 10, is the axial directional sensor 5, the disk 16 being surrounded by axial magnetic bearings 11 at outer circumferential regions thereof. Between the boundary faces of the disk 16 and the axial magnetic bearings 11 disposed around the latter, a magnetic field 15 is formed in the axial air gaps 14 in the region of the axial magnetic bearings 11. The position of the cylinder 7 can be influenced by, respectively, controlling and influencing the magnetic field 15 at the radial and axial bearings 11 and 12, respectively. The position of the journals 8 and of the disk 16, respectively, which are attached to the cylinder 7 is monitored by the sensors which, at the same time, control the influencing of the magnetic field 15 in the air gaps 17 and 14, respectively.

Figure 2:
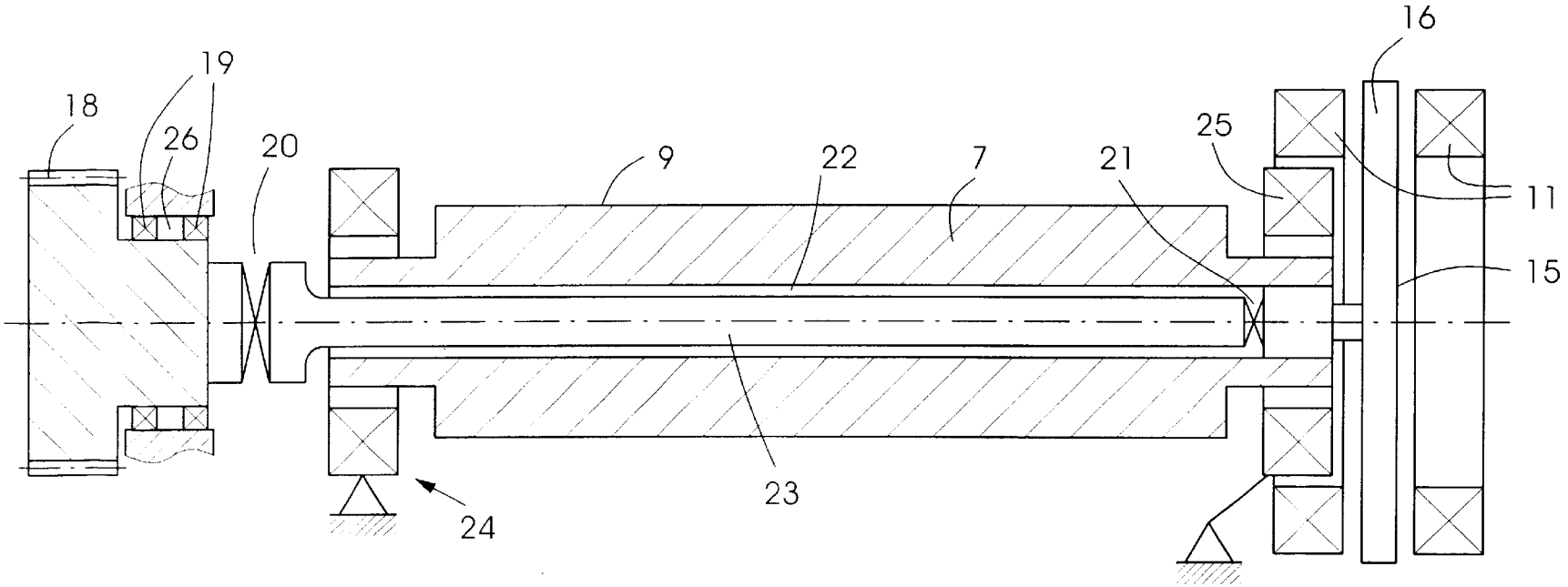
FIG. 2 is a diagrammatic longitudinal sectional view of a drive configuration having a rotationally rigid drive shaft of a cylinder for conveying sheetlike material, the cylinder being accommodated in axial/radial bearings.

FIG. 2 shows in greater detail the drive configuration of a cylinder accommodated in magnetic bearings operating without contact.

A gear 18, which can be accommodated with a double bearing 19 in an otherwise here not specifically illustrated printing unit, for example, of a multicolor rotary printing machine, is connected on the drive side 20 to a drive shaft 23 via a coupling element. By a second coupling element 21 located on the operating side, the torque transmitted from the gear 18 to the drive shaft 23 is introduced into the body of the cylinder 7. This avoids the introduction of unnecessary additional forces into the cylinder 7, which would have to be compensated for by the magnetic bearings 11, 12 acting radially and axially. By using the configuration according to FIG. 2, decoupling of the gear forces may be achieved because, through the intermediary of the drive shaft 23 configured as a cardan shaft or universal, the radial and axial movements of the cylinder can be decoupled from the rotational movement of the drive shaft 23, this being assured virtually without oscillation for the purpose of transmitting the torque, due to the stiffness inherent in the drive shaft 23.

The drive shaft 23, which is advantageously configured as a cardan shaft or universal, is accommodated in a bore 22 formed in the body of the cylinder 7. The cylinder bearings 24 and 25, respectively, are formed as fixed bearings acting radially without contact, for which reference may be made to FIG. 1. Illustrated on the operating side on an extension of the drive shaft 23 is the disk-like element 16 which, in the outer radial regions thereof, is surrounded by the axial magnetic bearing 11 and which builds up the magnetic field 15 between the disk-like element 16 and the magnetic coils, which is necessary for transferring the load bearing forces.

Figure 3:
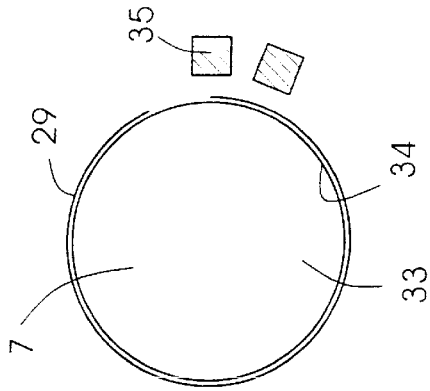
FIG. 3 is a diagrammatic longitudinal plan view of the jacket surface of a cylinder for conveying sheetlike material, the cylinder having gripping devices and sensors for sensing the leading edge and lateral or side edges, respectively, of the sheetlike material.
Figure 3:
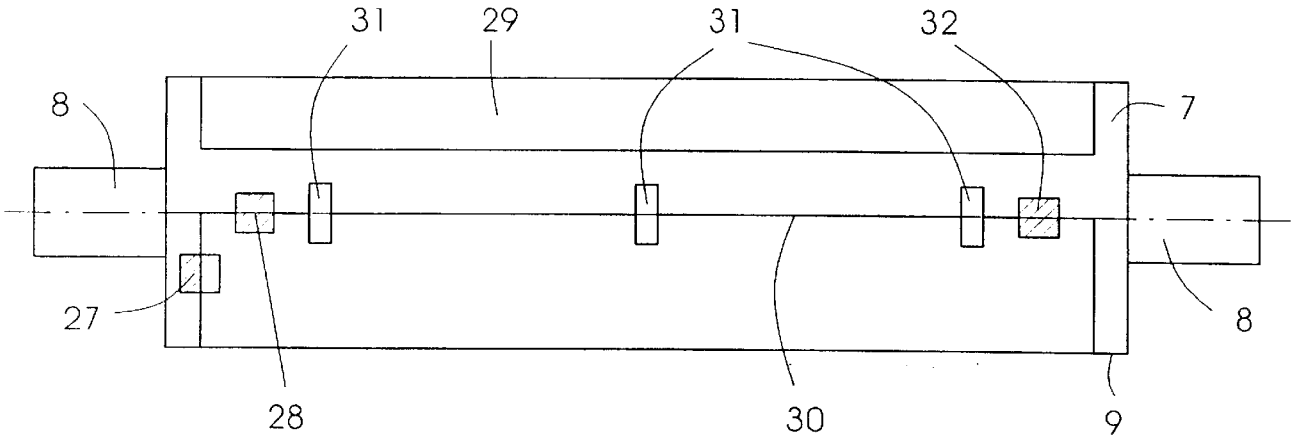

FIG. 3 shows in greater detail a diagrammatical plan view of a cylinder carrying sheet material, and FIG. 3' is an end view thereof.

The sheet material 29 is gripped at a leading edge 30 thereof by gripping devices 31 distributed over the width of the cylinder 7. The position of the leading edge 30 of the sheet material 29 on the circumference 9, 34 of the cylinder 7 is detected by sensors 28 and 32. The latter can operate both as edge detectors both in accordance with the capacitive or inductive measurement principle, and can also be configured as CCD arrays or as linear CCD sensors.

In addition to the detection of the position of the leading edge 30 of the sheet material 29 on the circumference 9 of the cylinder 7, the position of the side edges is determined by sensors 27 for detecting the side edge position 26. The side view of the cylinder 7 according to FIG. 3 shows the circumferential region 34 of the cylinder 7 which is covered by the longitudinal extent of the sheet material on the jacket surface 34. A stationary sensor unit 35 is disposed in the printing unit, outside the cylinder 7. Using the sensor unit 35, the actual position of the leading edge 30 of the sheet material 29 is determined.

FIG. 4*a* shows in greater detail the skewed position of the sheet material 29 on the circumference of a cylinder accommodating the sheet material 29.

In comparison with the vertically extending cylinder axis of the cylinder 7, the leading edge 30 of the sheet material 29 runs obliquely with respect thereto. Therefore, the side edges 30.1 of the sheet material 29 on the circumference of the cylinder 7 also run obliquely with respect to one another.

In order to compensate for a skewed position, illustrated in FIG. 4*a*, of the sheet material 29 in the printing unit of a sheet-processing machine, a different displacement of the journals 8 of the cylinder 7 on the drive side 38 and on the operating side 39 is necessary. This can be implemented in a simple way by the device according to the invention, by exerting different degrees of influence on the radial bearings 12 which accommodate the cylinder 7 carrying the sheetlike material 29 in the side walls 52 of a machine. Depending upon the influence of the magnetic field which generates the load bearing forces permitting the cylinder 7 to be held, it is possible to produce a different compensation for the air gaps on the drive side 38 and the operating side 39. As a result, the cylinder journals 8 enclosed by the radial/axial magnets are set into different positions relative to the bores in the side walls, with different air gaps.

In FIG. 4*a'*, the side view of the cylinder 7 reveals in greater detail the different positions, reproduced herein in broken lines, of the two ends 13 of the sheet-carrying cylinder 7 during a skewed position in a sheet-processing machine.

FIG. 4*b* shows the displacements of a cylinder guiding a sheetlike material, which are required to compensate for the circumferential position of the sheetlike material on the cylinder.

The nominal position 40 is the position which the cylinder axis 10 of the cylinder 7 is supposed to assume in order to compensate for the deviation $\Delta X$ in the circumferential direction. The actual position 41 is the position which the cylinder axis 10 of the cylinder 7 actually assumes. The difference between the actual position and the nominal position represents the position deviation 42 in the X direction, i.e., in the circumferential direction. Because, in the case of this position deviation, the travels in the X direction of the two journals 8 of the cylinder 7 are identical, the radial magnetic bearings 12 are driven simultaneously with the same intensity so that the cylinder axis 10 moves from the actual position 41 thereof into the nominal position 40 thereof. This is accompanied by a position change according to the spaced distance 42, which is shown in the side view of FIG. 4*b'*.

In the interest of being as complete as possible, it should be mentioned that reference numeral 43 identifies the rotation in counter-clockwise direction, as viewed in FIG. 4*b'*, of the cylinder 7 accommodating the sheetlike material 29 on the jacket surface 34 and 9, respectively, of the cylinder 7.

FIG. 4*c* shows in greater detail the correction of an erroneous lateral position of a cylinder 7 guiding sheetlike material.

A comparison of the actual lateral position and the nominal lateral position of the sheet material 29 on the circumferential surface 34 and 9, respectively, of the cylinder 7 reveals the correction value 44 of the lateral displacement ΔZ, by which the cylinder 7 accommodating the sheet material 29 on the circumferential surface 34 and 9, respectively, thereof, must be displaced in the Z direction represented by the arrow 3. Due to the axial magnetic bearing 11 according to FIGS. 1 and 2, influence is exerted upon the magnetic field 15 generated by the axial magnetic bearing 11 and surrounding the disk-like element 16. By the influencing of this magnetic field 15, an axial displacement of the cylinder body 7 occurs in the direction of the arrow 3 representing the Z axis.

Figure 5:
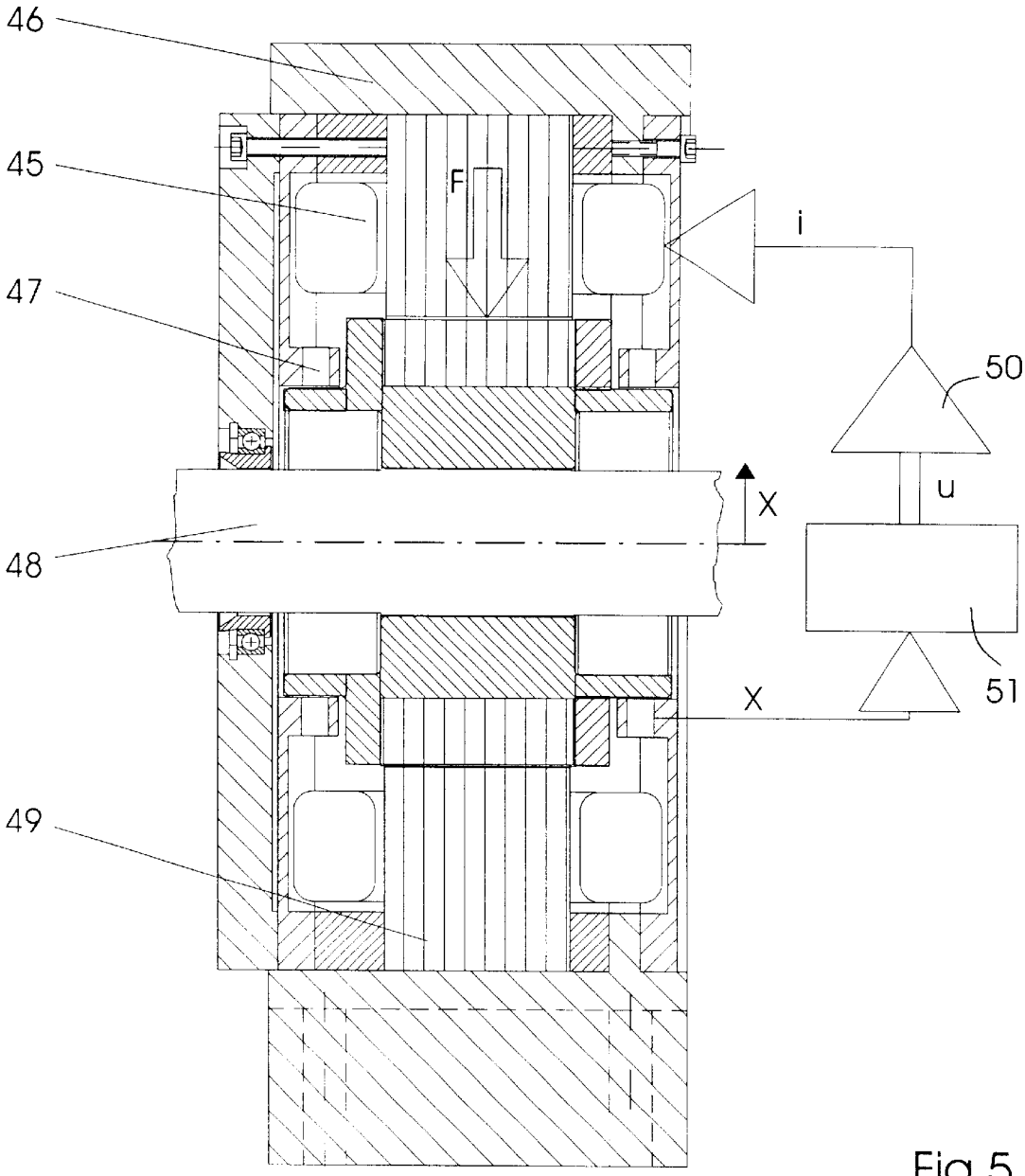
FIG. 5 is a schematic view, partly in section, of a magnetic mounting of a shaft according to the prior art.

FIG. 5 shows in greater detail the non-contact controlling of a magnet accommodating a shaft element 48.

Accommodated in a housing 46 is a magnetic coil 45, which encloses a laminated stator core 49. On the stator side, the shaft 48 is provided with a laminated core, an air gap being formed between stator and rotor. All disturbances which lead to the rotor 48 moving out of the nominal position thereof are stabilized by a suitable control 51. In this regard, the nominal position of the rotor is a firmly defined variable. In the adaptation of the concept illustrated in FIG. 5, the nominal position of the respective radial and axial magnetic bearing 11 and 12, respectively, must be varied exactly by the erroneous position of the sheet material 29. If a magnetic bearing has a different nominal position assigned thereto, the current i in the respective electromagnet 11, 12 is then varied by a power amplifier 50 so that a force acts upon the rotor 48, and the position of the rotor 48 is therefore changed. The new control deviation may be changed by the control 51.

For each cylinder 7, a radial magnetic bearing 12 has to be arranged on the drive side 38 and the operating side 39 in a rotary printing machine. For the radial mounting of the cylinder and in order to apply the necessary load bearing forces, four U magnets are needed in order to monitor a movement in all spatial directions. The axial magnetic bearing 11 can be arranged to be either on the drive side 38 or on the operating side 39. The radial and axial position, respectively, of the cylinder 7 and of the disk-like element 16, respectively, and also that of the cylinder journals 8, can be detected via directional sensors 5 or 6, which can be constructed to operate either on the inductive or the capacitive principle. The stators associated with the magnetic bearings 11 and 12, respectively, are mounted in a space-saving manner in the side walls 52 of the sheet-processing machine.

Figure 6:
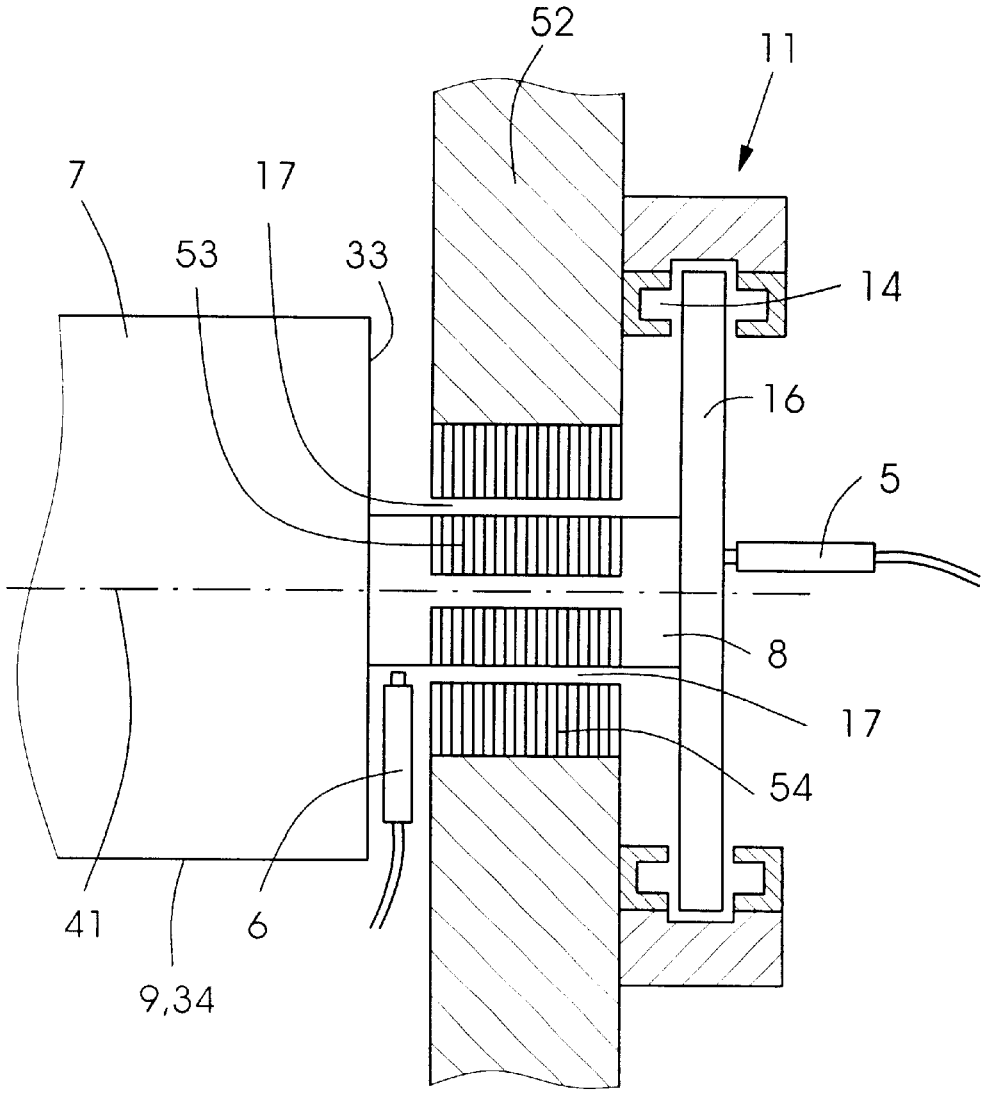
FIG. 6 is a diagrammatic view, partly in section, of a non-contact magnetic mounting of a cylinder shaft according to the invention, which acts in axial and radial directions, the magnetic mounting having magnets integrated in a bore formed in a side wall and magnets integrated into the circumferential surface of a journal of the cylinder.

FIG. 6 shows in greater detail the integration of stator and rotor parts of a magnetic mounting in a cylinder journal 8 and side walls 52.

The cylinder 7 of FIG. 6, which is provided with a cylinder journal 8, includes a disk-like element 16 according to the configuration of FIGS. 1 and 2. Radial bearing magnets 53 (rotor) are integrated into the jacket surface of the cylinder journal 8. Opposite the latter, in a side wall 52 of a sheet-processing machine, stator-side magnetic coils 54 of a radial magnetic bearing 12 are accommodated. The disk-like element 16 is surrounded in outer regions thereof by an electromagnet 11 functioning as an axial bearing and forming air gaps 14. The axial movement of the disk-like element 16 and, therefore, of the cylinder 7 is detected by a sensor 5 operating on the capacitive or inductive principle.

The circumferential surface of the cylinder journal 8 of the cylinder 7 has a radial directional sensor 6 assigned thereto. FIG. 6 shows that, between the rotor components 53 and the stator components 54 of the radial bearing 11, an air gap 17 is formed. Depending upon the erroneous position of the sheet material 29 to be aligned, which is to be compensated for, the air gap 17 can also assume a different configuration, i.e., can be located asymmetrically in relation to the axis of the bore in the side wall 52. By using the device according to the invention proposed herein, those necessary radial magnetic bearing forces may be generated which arise due to the necessary static forces plus the dynamic forces of the cylinder. The forces arising from the weight of the cylinder 7 accommodating the sheet material 29 on the circumferential surface 9 and 34, respectively thereof, therefore have to be reduced as far as possible.

The method proposed by the invention and the device proposed by the invention for aligning flat sheet material may be used both on a multicolor rotary printing machine operating on the conventional offset principle and on a printing machine embodying a plurality of digital printing units in tandem or behind one another. Furthermore, the invention may be used on all machines which process such sheetlike materials and which call for high alignment accuracy on flat material processed in this manner.

The invention of the instant application has been described hereinbefore with regard to cylinders for transporting sheetlike material. Other cylinders involved in printing, such as printing-form cylinders or transfer cylinders are likewise covered by the invention.

By illustrated radial adjustment, pairs of mutually cooperating cylinders can be accurately adjusted to a desired impression pressure.

In the registration or alignment of the printing-form cylinder or the printed-image transfer cylinder, besides the printed image, the edges of the printing form or of the printed-image carrier (for example, rubber blanket) on the printed-image transfer cylinder can also be determined by sensors.

We claim:

1. A method of aligning flat copies in a sheet-processing machine, which comprises the steps of determining the actual position of a sheetlike material in relation to a coordinate system; implementing a nominal position of a cylinder that accommodates the sheetlike material to be aligned on the jacket surface of the cylinder by correctively controlling non-contacting radial/axial magnetic bearings so as to compensate for position changes of one of the cylinder and components thereof from the nominal position; and maintaining the cylinder in the nominal position thereof until the aligned sheet material is transferred to transport units arranged farther downline.

2. The method according to claim 1, which includes guiding the sheetlike material during the rotation of the cylinder, and detecting the actual position of the leading edge and side edges of the sheetlike material by sensors.

3. The method according to claim 2, which includes independently displacing the cylinder, which guides the sheetlike material, on the drive side and on the operating side of the cylinder, for correcting a skewed position of the sheetlike material.

4. The method according to claim 1, which includes performing a like displacement of the cylinder, which guides the sheetlike material, on the drive side and on the operating side of the cylinder, for correcting a circumferential position of the sheetlike material.

5. The method according to claim 1, which includes axially displacing the cylinder, which guides the sheetlike material, for correcting the erroneous position of the sheetlike material.

6. The method according to claim 1, which includes monitoring the nominal position of the cylinder, which guides the aligned sheetlike material, by axial and radial sensors, respectively, for controlling the radial/axial magnetic bearings.

7. The method according to claim 1, which includes axially displacing the cylinder, which carries the printed image, for correcting the erroneous position of the printed image.

8. The device according to claim 1, wherein the sheet-processing machines are selected from the group consisting of multicolor rotary printing machines and digitally operating printing machines.

9. A method of aligning cylinders carrying a printed image in a printing machine, which comprises the steps of determining the actual position of the printed image in relation to a coordinate system; and implementing a nominal position of a cylinder that accommodates the printed image to be aligned on the jacket surface of the cylinder by correctively controlling radial/axial magnetic bearings so as to compensate for position changes of one of the cylinder and components thereof from the nominal position.

10. The method according to claim 9, which includes, during the rotation of the cylinder carrying the printed image, detecting by sensors the actual position of the cylinder carrying the printed image.

11. The method according to claim 10, which includes independently displacing the cylinder, which carries the printed image, on the drive side and on the operating side of the cylinder, for correcting a skewed position of the printed image.

12. A device for aligning flat copies in sheet-processing machines wherein sheetlike material is conveyed by gripping devices on a circumferential surface of a driven cylinder, comprising radial/axial bearings for mounting the driven cylinder without contact therewith, the driven cylinder being accommodated in side walls and serving to carry the sheetlike material, and sensors assigned to said radial/axial bearings for detecting axial and radial position changes, respectively.

13. The device according to claim 12, wherein said sensors serve for detecting the position of the sheetlike material on the circumference of the cylinder and are constructed as at least one CCD array and linear CCD sensor.

14. The device according to claim 12, wherein said sensors serve for detecting the position of the sheetlike material on the surface of the cylinder and are constructed as at least one of capacitive and inductive sheet edge detectors.

15. The device according to claim 12, including a drive to the cylinder carrying the sheetlike material, said drive being provided via a drive element connected via couplings to a drive shaft of the cylinder, said couplings serving for decoupling radial and axial movements of the cylinder.

16. The device according to claim 15, wherein said drive shaft is constructed as a cardan or universal shaft.

17. A device for aligning printed images in printing machines, wherein a printed image is carried by at least one cylinder selected from the group thereof consisting of printing form cylinders and transfer cylinders, comprising radial/axial bearings for mounting the cylinder without contact therewith, the cylinder being accommodated in side walls, and sensors assigned to said radial/axial bearings for detecting axial and radial position changes, respectively.

18. The device according to claim 17, wherein, on the cylinders carrying the printed image, sensors for detecting the position of a leading edge and a side edge of the printed image are accommodated.

19. A printing unit having a device for aligning flat copies in sheet-processing machines wherein sheetlike material is conveyed by gripping devices on a circumferential surface of a driven cylinder, comprising radial/axial bearings for mounting the driven cylinder without contact therewith, the driven cylinder being accommodated in side walls and serving to carry the sheetlike material, and sensors assigned to said radial/axial bearings for detecting axial and radial position changes, respectively.

20. A multicolor rotary printing machine having a device for aligning flat copies in sheet-processing machines wherein sheetlike material is conveyed by gripping devices on a circumferential surface of a driven cylinder, comprising radial/axial bearings for mounting the driven cylinder without contact therewith, the driven cylinder being accommodated in side walls and serving to carry the sheetlike material, and sensors assigned to said radial/axial bearings for detecting axial and radial position changes, respectively.

* * * * *